US005212360A

United States Patent [19]

Carlson

[11] Patent Number: 5,212,360

[45] Date of Patent: May 18, 1993

[54] LINE VOLTAGE SENSING FOR MICROWAVE OVENS

[75] Inventor: Roger W. Carlson, Cedar Rapids, Iowa

[73] Assignee: Amana Refrigeration, Inc., Amana, Iowa

[21] Appl. No.: 577,227

[22] Filed: Sep. 4, 1990

[51] Int. Cl.[5] ..... H05B 6/68

[52] U.S. Cl. ..... 219/10.55 B; 219/10.55 R; 219/10.55 F; 219/10.55 C; 323/205; 323/211; 363/142

[58] Field of Search ..... 219/10.55 B, 10.55 F, 219/10.55 R, 10.55 C; 323/205, 211, 283, 284, 285; 363/142, 143, 285, 287

[56] References Cited

U.S. PATENT DOCUMENTS 4,415,964 11/1983 Scharfe, Jr. ..... 363/142
4,428,015 1/1984 Nesler ..... 361/285
4,539,453 9/1985 Miyazaki et al. ..... 219/10.55 B
4,656,571 4/1987 Umezu ..... 363/143
4,900,884 2/1990 Aoki ..... 219/10.55 B
4,939,330 7/1990 Berggren et al. ..... 219/10.55 B

*Primary Examiner*—Bruce A. Reynolds
*Assistant Examiner*—Tuan Vinh To
*Attorney, Agent, or Firm*—William R. Clark; R. M. Sharkansky

[57] ABSTRACT

A microwave oven with a power supply including a transformer having primary and secondary windings, with the primary winding having a plurality of input connections and a secondary winding being coupled to a magnetron. The microwave oven includes a circuit the magnitude of a line voltage supplied to the microwave oven and, in response thereto, for coupling the line voltage to a corresponding one of the input connections to regulate the voltage provided across the secondary winding to the same voltage level regardless of the magnitude of the line voltage.

10 Claims, 2 Drawing Sheets

LINE VOLTAGE SENSING FOR MICROWAVE OVENS

BACKGROUND OF THE INVENTION

This invention relates generally to microwave ovens and more particularly to microwave ovens adapted to operate with alternate line voltages.

As it is known in the art, power distribution varies in the United States and in foreign countries and often varies even within a country. For example, power distribution in the United States servicing commercial business locations generally provides a nominal voltage of either 208 VAC or 240 VAC.

As it is also known in the art, microwave ovens include a magnetron which generates energy at microwave frequencies suitable for cooking. Microwave ovens further include a power supply, having an output coupled to the magnetron, such power supply providing high voltage, on the order of several thousand volts, to the magnetron. The power supply generally includes a step-up or power transformer, and it is desirable that, regardless of whether the microwave oven is supplied with a nominal line voltage of 208 VAC or 240 VAC, the same voltage be provided across the secondary winding. The power supply should also maintain the same voltage across the secondary winding when the line voltage varies over standard ranges or tolerances, such tolerances typically being on the order of $+10/-15\%$ and caused by load variations. Providing the same voltage across the secondary winding regardless of the voltage across the primary winding is necessary in order to regulate the output power of the magnetron to within a predetermined range since, if the output power were higher or lower than expected, the preset cooking times for the various cooking programs would result in the food being undercooked or overcooked.

One technique known in the art for providing the same high voltage at the output of the power supply, regardless of whether the microwave oven is connected to a 208 VAC or 240 VAC line voltage, is to provide a series of jumpers or switches which, when set appropriately, configure the power supply, and specifically the power transformer, for either 208 VAC or 240 VAC operation. More specifically, the step-up transformer of the power supply is provided with a plurality of different input connections on the primary winding, and, depending on the line voltage, the line is connected to the appropriate input connection. However, the use of such jumpers or switches to modify the microwave oven for operation with different line voltages generally requires a service technician to set the jumpers or switches appropriately. Further, the service technician generally has to visit the site of the microwave oven installation so that the line voltage, if not known, can be measured to determine the proper settings for the jumpers or switches. However, such a required service visit generally increases the overall cost of the oven as well as the time of installation for the oven.

SUMMARY OF THE INVENTION

In accordance with the present invention, a microwave oven includes a magnetron, a high voltage power supply, and means for sensing the magnitude of the line voltage supplied to the microwave oven. The high voltage power supply includes a transformer having primary and secondary windings, said primary winding having a first input connection providing a predetermined voltage across said secondary winding in response to a first line voltage. The primary winding also has a second input connection providing substantially the same predetermined voltage across said secondary winding in response to a second line voltage, different from the first line voltage. The microwave oven further includes means for sensing the magnitude of the line voltage supplied to the microwave oven and, in response thereto, for coupling the line voltage to a corresponding one of the first and second input connections to provide said predetermined voltage across the secondary winding. The line voltage is provided between two phases, but may alternately be provided between phase and neutral.

With such an arrangement, the line voltage supplied to a microwave oven is sensed and, depending on its magnitude, is automatically coupled to the appropriate one of a plurality of input connections on the primary winding of a transformer to provide substantially the same voltage across the secondary winding of the transformer regardless of the magnitude of the line voltage. The secondary winding is coupled to a magnetron which is therefore supplied with substantially the same voltage regardless of the line voltage. By supplying the same voltage to the magnetron regardless of line voltage, the output power of the magnetron is regulated to provide substantially the same output power for cooking, regardless of which one of a plurality of alternate line voltages is supplied to the microwave oven. Thus, a service technician is not required to manually jumper the AC line voltage to the appropriate one of the plurality of power transformer primary winding input connections. Further, if large deviations in a line voltage occur, the provided arrangement compensates for such deviations. For example, if 240 VAC distribution is operating at a level lower than permitted by the standard tolerance range, such as at 200 VAC, the present invention switches the primary winding input connection to which the line voltage is coupled in order to provide a higher voltage across the secondary winding and maintain substantially the same magnetron output power.

BRIEF DESCRIPTION OF THE DRAWINGS

The foregoing features of this invention, as well as the invention itself, may be more fully understood from the detailed description of the drawings in which.

DESCRIPTION OF THE PREFERRED EMBODIMENTS

Figure 1:
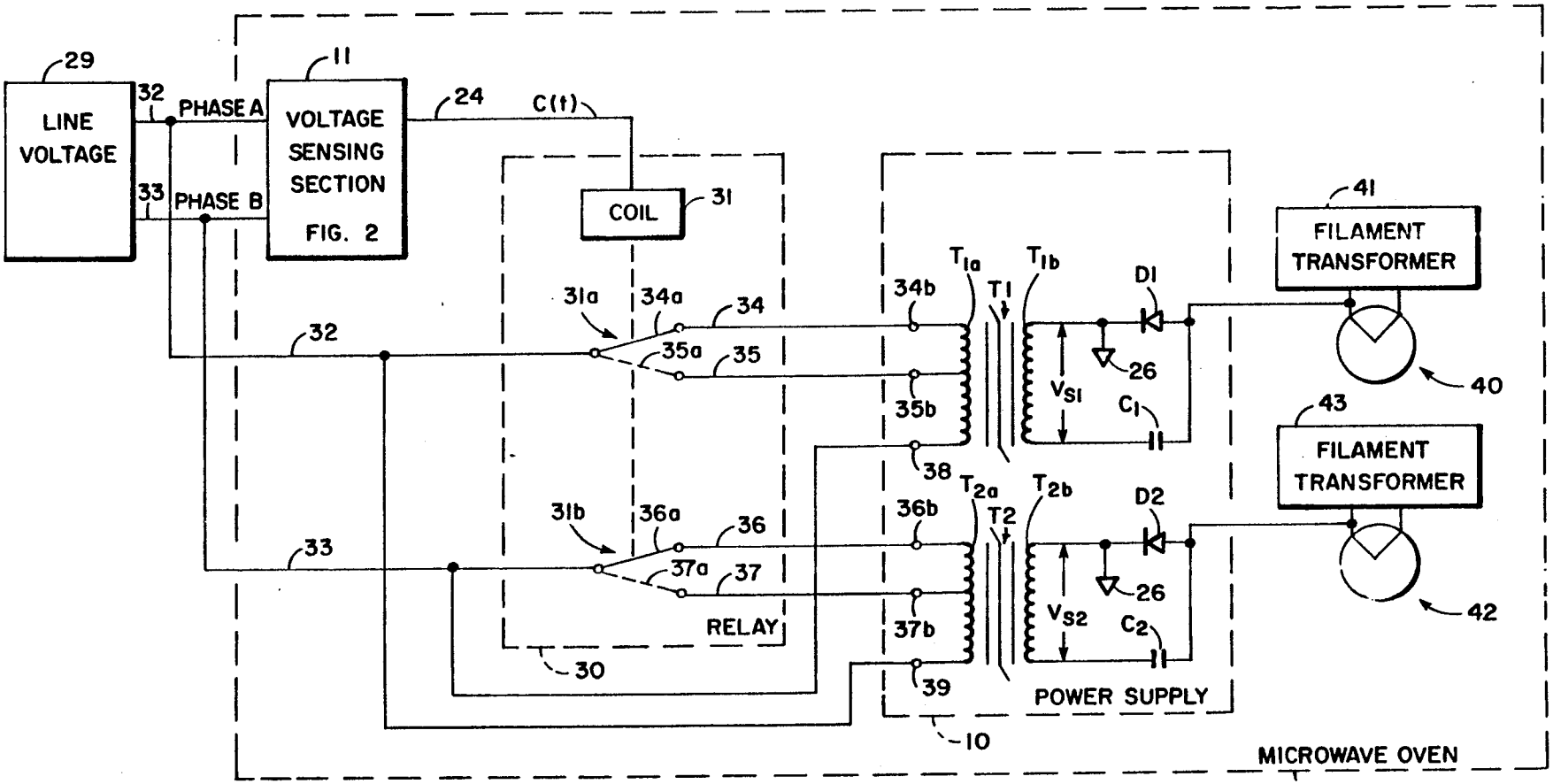
FIG. 1 is a schematic of a microwave oven in accordance with the present invention.

Referring now to FIG. 1, a conventional microwave oven 25 includes a power supply 10 coupled to a magnetron, here two magnetrons 40 and 42. The microwave oven 25 further includes a voltage sensing section 11 and a relay 30. The power supply 10 provides high voltage to a magnetron, here approximately 4,000 volts to two magnetrons 40 and 42, to provide the preferred power level of approximately 1400 watts for cooking, with each magnetron 40 and 42 providing approximately 700 watts.

The voltage sensing section 11 is coupled to a line voltage 29, and in particular to a phase "A" 32 and a phase "B" 33 of line voltage 29. Voltage sensing section 11 determines which one of a plurality of alternate line voltages is being supplied to microwave oven 25. Although, here the line voltage 29 is provided between phase "A" 32 and phase "B" 33, the present invention is equally well suited for application in which the line voltage is provided between the phase and the neutral connections of a line voltage. Here, the plurality of alternate line voltages consists of 208 VAC or 240 VAC nominally. Due to standard tolerances of these line voltages, here a line voltage above 230 VAC is considered to correspond to 240 VAC, and a line voltage below 230 VAC corresponds to 208 VAC. Upon the determination of which of the alternate line voltages, 208 VAC or 240 VAC, is coupled thereto, voltage sensing section 11 provides a control voltage c(t) via voltage path 24. The control voltage c(t) corresponds to the magnitude of the coupled one of the plurality line voltages 29 as will be described further in conjunction with FIG. 2.

Control voltage c(t) is coupled to a relay 30 and in particular to a coil 31 of relay 30. Here, a double pole double throw relay 30 is used, having two switches 31*a* and 31*b*. Switches 31*a* and 31*b* are coupled to phase "A" 32 and phase "B" 33 of line voltage 29 respectively. Switch 31*a* selectively couples phase "A" 32 of line voltage 29 to one of a first plurality of outputs 34 or 35 of relay 30 and switch 31*b* selectively couples phase "B" 33 of line voltage 29 to one of a second plurality of outputs 36 or 37 of relay 30. Switches 31*a* and 31*b* of relay 30 operate simultaneously and are jointly controlled by control voltage c(t), such control voltage here activating the coil 31 of relay 30. Although a relay 30 is here used to provide selective coupling between phase "A" 32, phase "B" 33 of line voltage 29 and outputs 34–37, relay 30 may be more generally referred to as switching section 30 since other switching means may alternately be used.

The first plurality of output 34 and 35 of switching section 30 are further coupled to a power supply 10 and more particularly to input connections 34*b* and 35*b* respectively of a primary winding $T_{1a}$ of a transformer $T_1$. Transformer $T_1$, has a third primary winding input connection 38 which is coupled to phase "B" 33 of line voltage 29.

Similarly, the second plurality of outputs 36 and 37 of switching section 30 are also coupled to power supply 10 and in particular to input connections 36*b* and 77*b* respectively of a primary winding $T_{2a}$ of a transformer $T_2$. Transformer $T_2$ has a third primary winding input connection 39 coupled to phase "A" 32 of line voltage 29.

Figure 2:
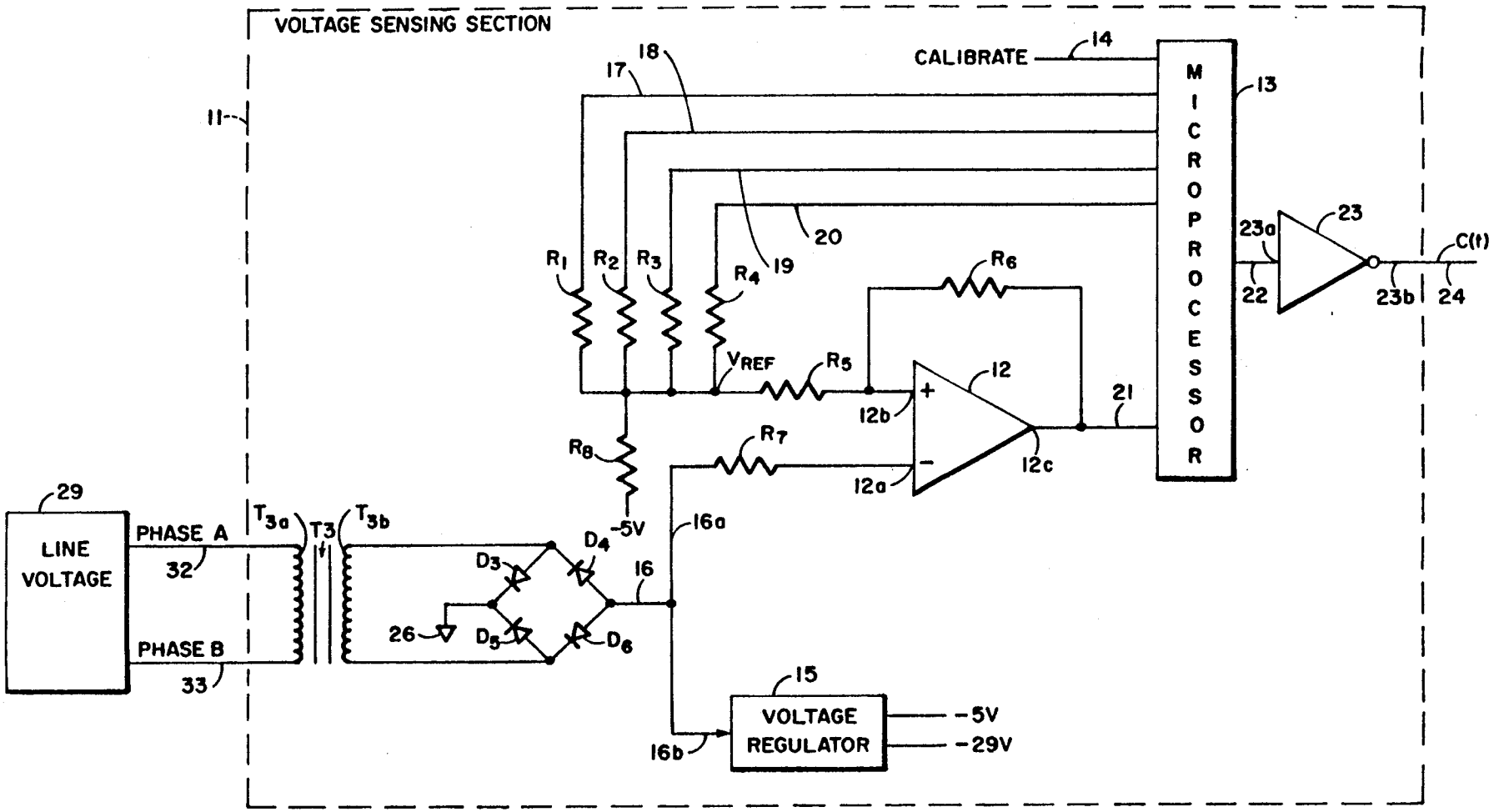
FIG. 2 is a schematic of the voltage sensing section of the microwave oven shown in FIG. 1.

In operation, when line voltage 29 has a value of 208 VAC nominally, voltage sensing section 11 provides control voltage c(t) at a first, low voltage potential, here approximately negative twenty-nine volts, in a manner which will be described further in conjunction with FIG. 2. At the first, low voltage potential, control voltage c(t) energizes switching section 30 to move switches 31*a* and 31*b* to positions 35*a* and 37*a* respectively. When switch 31*a* of switching section 30 is in position 35*a*, phase "A" 32 of line voltage 29 is coupled to output 35 of switching section 30, such output 35 being further coupled to input connection 35*b* of primary winding $T_{1a}$ of transformer $T_1$. With such an arrangement, the voltage potential between phase "A" 32 and phase "B" 33 of line voltage 29 appears across input connections 35*b* and 38 of primary winding $T_{1a}$ of transformer $T_1$. When switch 31*b* of switching section 30 is in position 37*a*, phase "B" 33 of line voltage 29 is coupled to output 37 of switching section 30, such output 37 being further coupled to input connection 37*b* of primary winding $T_{2a}$ of transformer $T_2$ thus providing the voltage potential between phase "A" 32 and phase "B" 33 of line voltage 29 across primary winding input connections 37*b* and 39 of transformer $T_2$.

When the line voltage 29 has a nominal value of 240 VAC, voltage sensing section 11 provides control voltage c(t) at a second, high voltage potential, here approximately 0 volts. Control voltage c(t) having a voltage potential approximately 0 volts, does not provide sufficient energy to switching section 30 to maintain switches 31*a* and 31*b* in positions 35*a* and 37*a*, and therefore switches 31*a* and 31*b* move to positions 34*a* and 36*a* respectively. When switch 31*a* of switching section 30 is in position 34*a*, phase "A" 32 of line voltage 29 is coupled to output 34 of switching section 30, such output 34 being further coupled to input connection 34*b* of primary winding $T_{1a}$ of transformer $T_1$, thus providing the voltage potential between phase "A" 32 and phase "B" 33 of line voltage 29 across input connections 34*b* and 38 of primary winding $T_{1a}$ of transformer $T_1$. When switch 31*b* of switching section 30 is in position 36*a*, phase "B" 33 of line voltage 29 is coupled to output 36 of switching section 30, which, as previously mentioned is further coupled to input connection 36*b* of primary winding $T_{2a}$ of transformer $T_2$ to provide the voltage potential between phase "B" 33 and phase "A" 32 of line voltage 29 across input connections 36*b* and 39 of primary winding $T_{2a}$ of transformer $T_2$.

Voltages $V_{S1}$ and $V_{S2}$ available at secondary windings $T_{1a}$ and $T_{2a}$ of transformers $T_1$ and $T_2$ provide energy to the magnetrons 40 and 42 of microwave oven 25 respectively. Each of voltages $V_{s1}$ and $V_{s2}$ is equivalent to the voltage applied to the primary winding of the respective transformer multiplied by the ratio of the number of secondary winding turns to the number of primary winding turns, such secondary winding turns remaining constant and primary winding turns varying according to which primary winding input connections are in use as previously described. By varying primary winding input connections according to which line voltage 29, 208 VAC or 240 VAC, is coupled to microwave oven 25, the ratio of the level of voltage applied to the primary winding to the number of primary winding turns is maintained constant, thus maintaining substantially the same voltage $V_{s1}$ and $V_{s2}$ available at secondary windings $T_{1b}$ and $T_{2b}$ of transformers $T_1$ and $T_2$ respectively, regardless whether the line voltage 29 is nominally 208 VAC or 240 VAC.

Secondary winding $T_{1b}$ of transformer $T_1$ has a first terminal coupled to the cathode of diode $D_1$ and a second terminal coupled to capacitor $C_1$. The anode of diode $D_1$ is coupled to capacitor $C_1$ and is further coupled to magnetron 40 and to the filament transformer 41 of magnetron 40.

In operation, during a first half cycle of the voltage applied to the primary winding $T_{1a}$ of transformer $T_1$, energy is transferred from secondary winding $T_{1b}$ of transformer $T_1$ through diode $D_1$ to charge capacitor $C_1$. Therefore, at the onset of a second half cycle of the voltage applied to the primary winding $T_{1a}$, capacitor $C_1$ has been charged to the voltage $V_{S1}$ and the same voltage $V_{S1}$ appears across secondary winding $T_{1b}$ of transformer $T_1$. Thus, during the second half cycle of the voltage applied to the primary winding $T_{1a}$ of transformer $T_1$, energy is transferred from secondary winding $T_{1b}$ of transformer $T_1$ and capacitor $C_1$ to the magnetron 40, applying to the magnetron 40 a voltage having a value equal to approximately twice the voltage available at the secondary winding $T_{1b}$ of transformer $T_1$, or $2 \cdot V_{s1}$.

Similarly, secondary winding $T_{2b}$ of transformer $T_2$ has a first terminal coupled to the cathode of a diode $D_2$. A second terminal of secondary winding $T_{2b}$ of transformer $T_2$ is coupled to a capacitor $C_2$. The anode of diode $D_2$ is coupled to capacitor $C_2$ and to magnetron 42 and to the filament transformer 43 of magnetron 42, such magnetron 42 receiving energy in the same manner as described above in conjunction with magnetron 40.

As previously mentioned, two magnetrons 40 and 42 are used in microwave oven 25 to provide a total of approximately 1400 watts of power for microwave cooking, each magnetron 40 and 42 providing approximately 700 watts. However, other applications not requiring a power level exceeding the capability of a single magnetron, may alternately use a single magnetron and therefore a single transformer and switching device to couple the line voltage 29 to the appropriate input connection of the transformer.

Referring now to FIG. , the voltage sensing section 11 of FIG. 1 is shown coupled to line voltage 29 and in particular to phase "A" 32 and phase "B" 33 of line voltage 29 to provide control voltage c(t) via voltage path 24 as will now be described. Phase "A" 32 of line voltage 29 is coupled to a first terminal of a primary winding $T_{3a}$ of a transformer $T_3$, such primary winding $T_{3a}$ being further coupled to phase "A" 33 of line voltage 29 at a second terminal thereof. A secondary winding $T_{3b}$ of transformer $T_3$ is coupled to a conventional full wave bridge rectifier arrangement including diodes $D_3$, $D_4$, $D_5$, and $D_6$ such that a first terminal of secondary winding $T_{3b}$ is coupled to the cathode of diode $D_4$ and to the anode of diode $D_3$ and a second terminal of secondary winding $T_{3b}$ is coupled to the cathode of diode $D_6$ and to the anode of diode $D_5$. The cathodes of diodes $D_3$ and $D_5$ are coupled together and logic ground 26 and the anode of diodes $D_4$ and $D_6$ are coupled together and to voltage path 16. Diodes $D_3$, $D_4$, $D_5$, and $D_6$ are connected in a conventional full wave bridge rectifier arrangement to effectively convert the AC voltage applied thereto, via secondary winding $T_{3b}$, into a substantially DC voltage at the interconnection between the anodes of diodes $D_4$ and $D_6$ (i.e. at voltage path 16).

Voltage path 16 is divided into two voltage paths **16*a*, 16*b*, one of which 16*b* feeds a voltage regulator 15. Voltage regulator 15 here provides −29 volts and −5 volts for use in control circuitry for the microwave oven 25. Here voltage regulator 15** is a conventional bipolar transistor arrangement, however other types of voltage regulators may alternately be used.

The second voltage path **16*a* provided by the full wave bridge rectifier arrangement of diodes $D_3$, $D_4$, $D_5$, and $D_6$, is coupled to the inverting input 12*a* of a comparator 12 and carries a voltage having a value proportional to line voltage 29. The non-inverting input 12*b* of comparator 12 is coupled to a reference voltage $V_{ref}$ via a resistor $R_5$. Reference voltage $V_{ref}$ is determined by a resistor network including resistors $R_1$–$R_4$ and $R_8$. Each of resistor $R_1$–$R_4$ a first terminal coupled to a signal line 17–20 respectively, such signal lines 17–20 carrying digital signals provided by a microprocessor 13. Second terminals of each of resistors $R_1$–$R_4$ are coupled together, and further to resistor $R_5$ and resistor $R_8$ to provide reference voltage $V_{ref}$ at such terminal. Resistor $R_8$ is further coupled to −5 volts provided by voltage regulator 15. Resistor $R_5$ is further coupled to the non-inverting input 12*b* of comparator 12 and a resistor $R_6$, such resistor $R_6$ being further coupled to the output 12*c* of comparator 12 and to an input of microprocessor 13 via signal line 21**.

Comparator 12 compares reference voltage $V_{ref}$ with the voltage carried by voltage path **16*a* to provide comparator output 12*c* in one of two logic states, a first, logic high state indicating that line voltage 32 is below a predetermined level, here 230 VAC or a second, logic high state indicating that line voltage 32 is above the predetermined level, here of 230 VAC. Resistor $R_6$ provides comparator 12 with hysteresis so that once the logic state of the output 12*c* of comparator 12 has changed state, such output 12*c* will not revert back to its initial state due to small fluctuations in the voltage applied to non-inverting input 12*a* of comparator 12** or in the reference voltage $V_{ref}$.

The way in which the digital signals provided by microprocessor 13 to signal lines 17–20 are determined is by using a calibration feature of microprocessor 13. The calibration feature is intended for use in a test environment, for example in the manufacturing facility of the microwave oven 25. To activate the calibration feature, signal line 14, which is normally (in operation) coupled to −5 volts, is coupled to a logic ground 26. Microprocessor 13 is programmed so that when signal line 14 has logic ground 26 coupled thereto, microprocessor 13 varies the digital signals provided on signal lines 17–20 until a change in logic state of the output **12*c* of comparator 12 occurs. In using the calibration feature, a voltage equal to that desired to differentiate between two input line voltages, here 230 VAC which differentiates an input line voltage of 208 VAC from 240 VAC, is applied to the primary winding $T_{3a}$ of transformer $T_3$, and the digital signals provided by microprocessor 13 on signal lines 17–20 are varied until the output 12*c* of comparator 12 changes state. The digital signals which provide the change in state at the output 12*c* of the comparator 12** are stored in a memory circuit and used in operation to generate the appropriate reference voltage $V_{ref}$.

In response to the logic state of output **12*c* of comparator 12, such output 12*c* being coupled to microprocessor 13 via signal line 21, microprocessor 13 provides a digital signal having an opposite logic state at signal line 22 which is coupled to the input of an inverting buffer 23. The output 23*b* of inverting buffer 23 provides control voltage c(t) via voltage path 24 to appropriately control switching section 30** as will be described hereinafter.

When the output **12*c* of comparator 12 is in its first, logic low state, indicating that line voltage 29 is below 230 VAC, microprocessor 13 provides a signal in the opposite logic state, here logic high, via signal line 22 to the input 23*a* of inverting buffer 23. The output 23*b* of inverting buffer 23 is provided in a low state, and here provides a voltage level of approximately negative twenty-nine volts. Control voltage c(t) provided at a level of approximately negative twenty-nine volts energizes switching section 30 (FIG. 1) to position switches 31*a* and 31*b* in positions 35*a* and 37*a* respectively as described in conjunction with FIG. 1**.

Similarly, when the output **12*c* of comparator 12 is in its second, logic high state, indicating a line voltage 29 above 230 VAC, microprocessor 13 provides a logic low signal, via signal line 22 to the input 23***a* of inverting buffer 23. The output 23*b* of inverting buffer 23, or equivalently control voltage c(t) is provided in a high state, here of approximately 0 volts. Control voltage c(t), provided at a level of approximately 0 volts, does not provide sufficient voltage to the switching section 30 to maintain the switches 31*a*, 31*b* in positions 35*a* and 37*a* and therefore such switches 31*a*, 31*b* move to positions 34*a* and 36*a* respectively.

Microprocessor 13 includes additional inputs and outputs coupled to microwave oven circuitry (not shown), such circuitry conventional in microwave ovens to provide inter alia memory capability, microwave oven display controls, and control for a microwave oven speaker. Microprocessor 13 further controls for safety switches (not shown) to be provided in the path between the line voltage 29 input to the microwave oven 25 and the voltage sensing section 11. The safety switches are provided, for example, to open the line voltage 29 path to the power supply 10 when the door of the microwave oven 25 is opened or when the magnetrons 40 and 42 are operating at an excessively high temperature.

In accordance with the present invention, the magnitude of the line voltage 29 supplied to a microwave oven 25 has been sensed and, in accordance therewith, the line voltage 29 has been coupled the appropriate input connection on the primary winding of a power transformer, the secondary winding of which is coupled to a magnetron. Accordingly, regardless of whether the microwave oven 25 is supplied a line voltage 29 with a nominal value of 208 VAC or 240 VAC, substantially the same voltage is automatically provided across the secondary winding of the power transformer. As a result, the output power of the magnetron is regulated to a predetermined level, such predetermined output power providing consistency in cooking with various cooking programs.

Generally, the voltage provided at the secondary winding of the filament transformers 41 and 43 must be regulated to within a relatively narrow range since, if the voltage is too high, the filament may overheat and its operating life could be reduced. If the filament voltage is too low, the magnetron may mode when it is being turned on. It should be noted that here, filament transformers 41 and 43 of magnetrons 40 and 42 are able to meet these requirements when operating over the range of input voltages corresponding to between 208 VAC and 240 VAC by using a conventional autotransformer. However, in other applications, for example where the alternate line voltages vary more than between 208 VAC and 240 VAC, it may be desirable to provide a similar arrangement to that previously described in conjunction with power transformers $T_1$ and $T_2$. In other words, it may be desirable to provide a plurality of input connections on the primary windings of filament transformers 41 and 43 and means for sensing the magnitude of the line voltage 29 supplied to the microwave oven 25 and, in response thereto, for coupling the line voltage 29 to a corresponding one of a plurality of primary winding input connections.

Having described preferred embodiments of the invention, it will now be apparent to one of skill in the art that other embodiments incorporating their concepts may be used. It is felt therefore that these embodiments should not be limited to the disclosed embodiments, but rather should be limited only by the spirit and scope of the appended claims.

What is claimed is:

1. A microwave oven comprising:

a magnetron;

a high voltage power supply coupled to said magnetron, said power supply comprising a transformer having primary and secondary windings, said primary winding having a first input connection providing a predetermined voltage across said secondary winding in response to a first line voltage, said primary winding further having a second input connection providing substantially the same predetermined voltage across said secondary winding in response to a second line voltage different from said first line voltage;

means for providing a reference voltage; and means comprising a comparator for sensing the magnitude of the line voltage supplied to said microwave oven and, in response thereto, for coupling said line voltage to a corresponding one of said first and second input connections to provide said predetermined voltage across said secondary winding, said comparator being fed by first and second voltages, said first voltage being proportional to said supplied line voltage and said second voltage being said reference voltage.

2. The microwave oven recited in claim 1 wherein said means for coupling said line voltage to a corresponding one of said first and second input connections includes a relay.

3. The microwave oven recited in claim 1 wherein said first and second line voltages are provided between two phases.

4. The microwave oven recited in claim 1 wherein said means for sensing the magnitude of the line voltage supplied to the microwave oven includes a microprocessor.

5. The microwave oven recited in claim 4 wherein said microprocessor comprises means for adjusting said reference voltage in response to a calibration control signal.

6. A microwave oven comprising:

means for providing a reference voltage;

means comprising a comparator for sensing the line voltage supplied to said microwave oven and for providing a control signal corresponding to the magnitude of the sensed line voltage, said comparator being fed by first and second voltages, said first voltage being proportional to said supplied line voltage and said second voltage being said reference voltage;

a power supply including a transformer having primary and secondary windings, said primary winding having a plurality of input connections;

means, responsive to said control signal, for selectively coupling said line voltage to one of said input connections to regulate the voltage across said secondary winding; and a magnetron receiving voltage from said power supply.

7. The microwave oven recited in claim 5 wherein the line voltage is provided between two phases.

8. The microwave oven recited in claim 5 wherein said means for sensing the line voltage supplied to said microwave oven includes a microprocessor.

9. The microwave oven recited in claim 8 wherein said microprocessor comprises means for adjusting said reference voltage in response to a calibration control signal.

10. The microwave oven recited in claim 5 wherein the means for selectively coupling said line voltage to one of said input connections includes a relay.

* * * * *